United States Patent [19]

Wagle et al.

[11] Patent Number: 4,828,650

[45] Date of Patent: May 9, 1989

[54] HEAT TREATMENT OF PAPER PRODUCTS HAVING MILK AND OTHER ADDITIVES

[75] Inventors: Dinkar G. Wagle, Monroe; Vacheslav M. Yasnovsky, Orangeburg, both of N.Y.; Jeffery R. Jones, Mobile, Ala.

[73] Assignee: International Paper Company, Purchase, N.Y.

[21] Appl. No.: 102,710

[22] Filed: Sep. 30, 1987

Related U.S. Application Data

[63] Continuation-in-part of Ser. No. 768,783, Aug. 23, 1985, abandoned.

[51] Int. Cl.[4] ..... D21H 3/14; D21H 3/38

[52] U.S. Cl. ..... 162/168.1; 162/169; 162/174; 162/207; 427/374.1; 427/382; 427/391; 427/395

[58] Field of Search ..... 162/135, 168.1, 175, 162/174, 204, 206, 202, 207, 169; 427/374.1, 382, 391, 395

[56] References Cited

U.S. PATENT DOCUMENTS 2,116,544 5/1938 Schur ..... 162/206
2,324,529 7/1943 Musher ..... 162/174

FOREIGN PATENT DOCUMENTS 380008 9/1932 United Kingdom ..... 162/174

OTHER PUBLICATIONS

Back et al., "Wet Stiffness by Means of Heat Treatment of Running Web," Pulp and Paper Canada, vol. 78, No. 11(1977) pp. 271-275.

*Primary Examiner*—Peter Chin
*Attorney, Agent, or Firm*—Walt Thomas Zielinski

[57] ABSTRACT

The stiffness, wet strength and bursting strength of paper is improved by adding a latex such as milk to the paper and then subjecting the paper to steps of high temperature treatment and immediate rewetting.

4 Claims, No Drawings

HEAT TREATMENT OF PAPER PRODUCTS HAVING MILK AND OTHER ADDITIVES

This application is a continuation-in-part of United States patent application Ser. No. 768,783, filed Aug. 23, 1985 abandoned.

BACKGROUND OF THE INVENTION

1. Field of the Invention:

This invention relates to the art of papermaking, particularly to treating paper products with milk and then high temperature to improve its properties, including wet stiffness, wet tensile strength and bursting strength.

2. Description of the Prior Art:

There is currently considerable interest in improving various properties of paper and boards. Quantifiable paper properties include: dry and wet tensile strength, folding endurance, stiffness, compressive strength, and bursting strength, among others. Which qualities should desirably be enhanced depends upon the intended application of the product. In the case of milk carton board, for example, stiffness is of particular importance, whereas for linerboard, wet strength, folding endurance, and high humidity compression strength may be more important.

All of these properties can be measured by well-known standard tests. As used herein, then, "wet strength" means wet tensile strength as measured by American Society for Testing and Materials (ASTM) Standard D829-48. "Folding endurance" is defined as the number of times a board can be folded in two directions without breaking, under conditions specified in Standard D2176-69. "Stiffness" is defined as flexural rigidity and is determined by the bending moment in g-cm. "Linerboard", as used herein, is a medium-weight paper product used as the facing material in corrugated carton construction, and is usually made from pulp produced by the kraft process. Folding carton board is a medium to heavy weight paper product made of unbleached and/or bleached pulps having basis weights from 40–350 g/m$^2$.

Prior workers in this field have recognized that high-temperature treatment of paperboard can improve its wet strength. See, for example E. Back, "Wet stiffness by heat treatment of the running web", *Pulp & Paper Canada*, vol. 77, No. 12, pp. 97–106 (Dec. 1976). This increase has been attributed to the development and cross-linking of naturally occurring lignins and other polymers, which phenomenon may be sufficient to preserve product wet strength even where conventional synthetic resins or other binders are entirely omitted.

It is noteworthy that wet strength improvement by heat curing has previously been thought attainable only at the price of increased brittleness (i.e., reduced folding endurance). Embrittled board is not acceptable for many applications involving subsequent deformation, and therefore heat treatment alone, to develop the wet strength of paperboard and carton board, has not gained widespread acceptance. Heat treatment has most successfully been used to produce hardboard. It has not been practiced on paper having latex or milk additives.

It is therefore an object of the invention to produce paperboard having both improved stiffness and wet strength, and adequate folding endurance.

With a view to the foregoing, a process has been developed which dramatically and unexpectedly increases not only the stiffness and wet tensile and bursting strengths of various paperboards, but also preserves their folding endurance. In its broadest sense, the invention comprises steps of (1) applying a natural latex, preferably milk, to paperboard, and then (2) heating the paperboard so treated to an internal temperature of at least 400° F. (205° C.) for a period of time sufficient to increase the wet strength of the board. We prefer to raise the internal temperature of the board to at least 450° F. (232° C.) during the heat treating step, as greater stiffness and wet strength are then achieved. This may be because at higher temperatures, shorter step duration is necessary to develop bonding, and there is consequently less time for fiber degradation to occur. Also, shorter required durations enable one to achieve higher production speeds for a treating apparatus of a given length.

While the heat treatment may cover a range of temperatures and durations, these factors are interrelated. Higher temperatures requires a heat treating step of shorter duration, and vice-versa. For example, at 550° F. (289° C.), a duration of 2 seconds has been found sufficient to obtain the desired improvements, while at 420° F., considerably longer is required.

Optionally, the paper may then be subjected to a third step of rewetting the board immediately after the heat treatment and while the paper temperature is above 100° C. to at least 1% mositure by weight. These steps are followed by conventional drying and/or conditioning of the treated board. It is to be understood that steps 2 and 3 can be repeated several times.

Of course, those skilled in the art will recognize the necessity of the product conditioning to a normal moisture content after this very hot treatment. See, for example, U.S. Pat. No. 3,395,219. A certain amount of remoisturizing is normally done, and in fact must be done prior to use or testing. Conventional rehumidification is done after the product has substantially cooled, at temperatures well below 100° C.

Our rewetting treatment differs from conventional conditioning in that we add water, by spraying or otherwise, to a very hot and dry paper or board at the very end of the heat treatment, without intermediate cooling. It is important that the water be applied to the product while it is still hot, certainly above 100° C. (212° F.), and preferably above 205° C. (400° F.). Another heat treatment or drying step may follow rewetting, on or off the machine, during a subsequent operation such as sizing, coating or calendering.

DESCRIPTION OF THE PREFERRED EMBODIMENT

The invention can be carried out either on a conventional papermaking machine or off the machine in an oven after a size-press, but for high speed production, a continuous papermaking machine would be used.

In either event, the paper fibers are first treated by adding a latex. Latex is a water-based suspension of protein, and milk is one naturally occurring latex. The additive may be mixed with the pulp prior to sheet forming, or it may be added to a formed sheet by spraying or other means. The wet web is conventionally pressed to unite the pulp fibers and remove excess water. Following wet pressing, the paper product is heat treated.

For the heat treatment step to be effective, the initial water content of the web must be in the range of 1–20% by weight and preferably within the 10–15% range. Sufficient heat is then applied to the board to achieve an internal paper temperature of at least 400° F. (205° C.). The heat can be applied in the form of hot air, superheated steam, heated drying cylinders, infrared heaters, or by other means. Alternatively, the paper may be heat-treated in an oven after a size-press. After heat treatment, if the paper is conventionally conditioned, improved wet strength will be observed.

Preferably, however, the paper is immediately rewetted following the heat treating step, and while it is still hot. To rewet the paper, water may be applied by spraying, immersion or other means. Even though one effect of the water application is to cool the paper, it is important that the paper not cool substantially before the water application. We have found that the best results are obtained when the paper is rewetted while the web is substantially still at heat treating temperature. In a continuous machine, this goal is achieved by placing the water applicator as close as possible to the exit of the heat treatment unit.

The heat treated and rewetted paper is dried, if necessary, and is then cooled, conditioned, and calendered according to conventional procedure.

The invention has been practiced as described in the following examples. An improvement in product quality will be apparent from an examination of the test results listed in the tables below.

EXAMPLE 1

A commercial bleached kraft board was sized with different potato starch (PS)/milk mixtures. The starch and milk solution concentrations were 8% and 4% polymer by weight, respectively. The size press pressure was adjusted to yield a polymer add-on of 2.4% by weight. A part of the samples was conventionally dried ("C" in the Tables) on Emerson speed drier, model 10 at 230° F. (110° C.). Another portion of the samples was heat treated ("HT" in the Tables) at 400° F. (205° C.) for 30 seconds and rewetted immediately after heat treatment. After conditioning for 48 hours under standard conditions (70° F., 65% relative humidity), the samples were tested. The results of testing appear in Table 1.

TABLE 1

| | NO MILK | | PS:MILK 50:50 | | PS:MILK 70:30 | |
|---|---|---|---|---|---|---|
| PROPERTIES | (C) | (HT) | (C) | (HT) | (C) | (HT) |
| Basis weight (lb/3000 ft$^2$) | 160.1 | 150.3 | 168.5 | 165.9 | 165.4 | 164.0 |
| Caliper (mils) | 18.9 | 19.0 | 19.2 | 18.6 | 19.2 | 18.6 |
| Corrected Stiffness g-cm (MD/CD) | 158/75 | 164/88 | 161/81 | 182/91 | 145/69 | 166/81 |
| % Stiffness Improvement (MD/CD) | — | 3.8/−9 | 1.9/8 | 15.2/21 | −8.2/−8 | 45.1/8 |

EXAMPLE 2

Board as in Example 1 was treated with a 50:50 mixture of starch and acrylic latex (Rohm-Maas Rhoplex HA-16). The starch and latex concentrations were 8% and 50% respectively. The size press pressure was adjusted to achieve a polymer add-on of 10.5%. A portion of the samples was conventionally dried on Emerson Speed drier, model 10 at 230° F. (110° C.). Another portion of the samples was heat treated at 400° F. (250° C.) for 30 seconds. All the samples were conditioned for 48 hours under standard conditions. The resultant sample properties are listed in Table 2.

TABLE 2

| | NO ADDITIVE | | PS:LATEX | |
|---|---|---|---|---|
| PROPERTIES | C | HT | C | HT |
| Basis weight (lb/3000 ft$^2$) | 160.1 | 150.3 | 179 | 177 |
| Caliper (mils) | 18.9 | 19.0 | 19.2 | 18.6 |
| Corrected Stiffness, g-cm (MD/CD) | 158/75 | 164/88 | 166/92 | 188/99 |
| % Stiffness Improvement (MD/CD) | — | 3.8/−9 | 5.1/22.6 | 19.5/32 |

EXAMPLE 3

A commercial kraft unbleached linerboard having a kappa number of 105 and Canadian Standard Freeness of 720 mls was sized and treated as in Example 1. All the samples were conditioned for 48 hours under standard conditions. The resultant board properties are listed in Table 3.

TABLE 3

| | NO ADDITIVE | | PS:MILK 50:50 | | WHOLE MILK | |
|---|---|---|---|---|---|---|
| Properties | C | HT | C | HT | C | HT |
| Basis weight lb/3000 ft$^2$ | 135.2 | 128.0 | 137.1 | 138.6 | 136.6 | 138.2 |
| Caliper (mils) | 12.9 | 12.4 | 12.9 | 12.6 | 13.0 | 12.4 |
| Dry Tensile lb/in MD/CD | 64.6/21.6 | 62.4/20.6 | 66.1/22.4 | 72.0/26.2 | 65.9/21.1 | 74.7/22.3 |
| Wet Tensile lb/in MD/CD | 8.1/3.1 | 9.6/3.3 | 6.9/2.5 | 15.3/4.9 | 6.2/2.3 | 16.4/5.5 |
| Stiffness g-cm | 14.8/5.0 | 14.0/5.0 | 16.5/5.3 | 16.0/6.3 | 16.3/4.8 | 15.8/4.8 |
| STFI comp. MD/CD | 46.7/24.5 | 21.7/44.6 | 46.7/26.6 | 51.0/27.7 | 44.2/22.6 | 48.6/21.5 |
| MIT Fold MD/CD | — — | 703/424 | — — | 1027/618 | — — | 1101/724 |
| Mullen | 147.3 | 121.3 | 164.0 | 156.7 | 15.7 | 148.7 |

EXAMPLE 4

The same board as in Example 3 was sized and treated as in Example 3, using a 50% potato starch, 50% latex mixture. All the samples were conditioned for 48 hours under standard conditions. The resultant product properties are listed in Table 4.

TABLE 4

| | NO ADDITIVE | | PS:LATEX 50:50 | |
|---|---|---|---|---|
| Properties | C | HT | C | HT |
| Basis weight lb/3000 ft$^2$ | 135.2 | 128.0 | 143.7 | 145.0 |
| Caliper (mils) | 12.9 | 12.4 | 13.1 | 12.3 |
| Dry Tensile lb/in MD/CD | 64.6/21.6 | 62.4/20.6 | 83.5/31.2 | 82.2/30.1 |
| Wet Tensile lb/in MD/CD | 8.1/3.1 | 9.6/3.3 | 13.7/4.7 | 24.8/9.6 |
| Stiffness g-cm | 14.8/5.0 | 14.0/5.0 | 15.3/6.8 | 16.5/6.0 |
| STFI comp. MD/CD | 46.7/24.5 | 21.7/44.6 | 53.6/29.6 | 57.0/31.0 |
| MIT Fold MD/CD | — — | 703/424 | — — | 939/559 |
| Mullen | 147.3 | 121.3 | 191.0 | 178.0 |

EXAMPLE 5

Samples of bleached kraft board were sized with various additives and then processed as in Example 1. The results of testing appear in tables 5.1–5.7.

TABLE 5.1

BLEACHED BOARD + NO ADDITIVES

| PROPERTIES | | | CONTROL | HT + REWET | HT ONLY |
|---|---|---|---|---|---|
| Basis Wt. (lb/3000 ft$^2$) | | | 209.1 | 208.4 | 209.4 |
| Caliper (0.001 in) | | | 21.9 | 21.4 | 21.5 |
| Tensile | Dry | MD | 88 | 108 | 101 |
| (lb/in) | | CD | 52 | 60 | 58 |
| % Stretch | | MD | 2.3 | 2.6 | 2.4 |
| | | CD | 3.5 | 4.1 | 3.9 |
| Tensile | Wet | MD | 19 | 37 | 31 |
| (lb/in) | | CD | 17 | 25 | 22 |
| % Stretch | | MD | 2.0 | 2.4 | 2.2 |
| | | CD | 2.5 | 3.7 | 3.5 |
| Mullen Burst | | Dry | 89 | 99 | 92 |
| (psi) | | Wet | 20 | 37 | 39 |
| Corrected Taber | | MD | 270 | 292 | 288 |
| Stiffness gm-cm | | CD | 145 | 161 | 165 |

TABLE 5.2

BLEACHED BOARD + STARCH (8% Aqueous) (4.8% Add-on)

| PROPERTIES | | | CONTROL | HT + REWET | HT ONLY |
|---|---|---|---|---|---|
| Basis Wt. (lb/3000 ft$^2$) | | | 212.0 | 213.7 | 210.2 |
| Caliper (0.001 in) | | | 21.3 | 20.8 | 20.2 |
| Tensile | Dry | MD | 124 | 121 | 128 |
| (lb/in) | | CD | 69 | 60 | 69 |
| % Stretch | | MD | 3.9 | 3.6 | 3.4 |
| | | CD | 5.1 | 4.8 | 4.8 |
| Tensile | Wet | MD | 30 | 35 | 28 |
| (lb/in) | | CD | 15 | 17 | 18 |
| % Stretch | | MD | 2.9 | 2.9 | 2.8 |
| | | CD | 5.4 | 5.2 | 5.5 |
| Mullen Burst | | Dry | 150 | 148 | 149 |
| (psi) | | Wet | 29 | 39 | 41 |
| Corrected Taber | | MD | 294 | 308 | 315 |
| Stiffness gm-cm | | CD | 168 | 172 | 181 |

TABLE 5.3

BLEACHED BOARD + SKIM MILK (3.5% Proteins) (5% Add-on)

| PROPERTIES | | | CONTROL | HT + REWET | HT ONLY |
|---|---|---|---|---|---|
| Basis Wt. (lb/3000 ft$^2$) | | | 208.2 | 210.4 | 208.1 |
| Caliper (0.001 in) | | | 21.9 | 21.0 | 20.5 |
| Tensile | Dry | MD | 95 | 107 | 108 |
| (lb/in) | | CD | 57 | 61 | 65 |
| % Stretch | | MD | 2.5 | 2.5 | 2.4 |
| | | CD | 4.0 | 4.2 | 4.1 |
| Tensile | Wet | MD | 29 | 42 | 47 |
| (lb/in) | | CD | 16 | 23 | 31 |
| % Stretch | | MD | 3.0 | 2.9 | 3.0 |
| | | CD | 5.4 | 5.6 | 6.0 |
| Mullen Burst | | Dry | 117 | 113 | 109 |
| (psi) | | Wet | 35 | 54 | 62 |
| Corrected Taber | | MD | 297 | 312 | 321 |
| Stiffness gm-cm | | CD | 138 | 150 | 158 |

TABLE 5.4

BLEACHED BOARD & CONDENSED MILK (7.0% Proteins) (4.8% Add-on)

| PROPERTIES | | | CONTROL | HT + REWET | HT ONLY |
|---|---|---|---|---|---|
| Basis Wt. (lb/3000 ft$^2$) | | | 215.6 | 214.7 | 212.7 |
| Caliper (0.001 in) | | | 21.5 | 21.1 | 20.8 |
| Tensile | Dry | MD | 112 | 110 | 118 |
| (lb/in) | | CD | 54 | 58 | 59 |

TABLE 5.4-continued

BLEACHED BOARD & CONDENSED MILK (7.0% Proteins) (4.8% Add-on)

| PROPERTIES | | | CONTROL | HT + REWET | HT ONLY |
|---|---|---|---|---|---|
| % Stretch | | MD | 2.5 | 2.5 | 2.5 |
| | | CD | 3.4 | 4.0 | 3.4 |
| Tensile | Wet | MD | 27 | 52 | 51 |
| (lb/in) | | CD | 14 | 25 | 25 |
| % Stretch | | MD | 2.4 | 2.8 | 2.8 |
| | | CD | 5.1 | 5.6 | 6.1 |
| Mullen Burst | | Dry | 111 | 110 | 115 |
| (psi) | | Wet | 28 | 57 | 48 |
| Corrected Taber | | MD | 301 | 312 | 333 |
| Stiffness gm-cm | | CD | 160 | 159 | 167 |

TABLE 5.5

BLEACHED BOARD & RECONSTITUTED DRY MILK (14% Proteins) (4.8% Add-on)

| PROPERTIES | | | CONTROL | HT + REWET | HT ONLY |
|---|---|---|---|---|---|
| Basis Wt. (lb/3000 ft$^2$) | | | 231.0 | 225.7 | 222.5 |
| Caliper (0.001 in) | | | 22.0 | 21.4 | 20.9 |
| Tensile | Dry | MD | 123 | 127 | 128 |
| (lb/in) | | CD | 66 | 69 | 71 |
| % Stretch | | MD | 2.6 | 2.7 | 2.4 |
| | | CD | 4.0 | 4.1 | 3.1 |
| Tensile | Wet | MD | 26 | 39 | 42 |
| (lb/in) | | CD | 14 | 23 | 22 |
| % Stretch | | MD | 2.8 | 3.4 | 3.5 |
| | | CD | 5.4 | 6.4 | 6.3 |
| Mullen Burst | | Dry | 143 | 139 | 121 |
| (psi) | | Wet | 33 | 46 | 51 |
| Corrected Taber | | MD | 335 | 396 | 398 |
| Stiffness gm-cm | | CD | 214 | 221 | 241 |

TABLE 5.6

BLEACHED BOARD + STARCH: RECONSTITUTED DRY MILK (7% Proteins) (5.0% Add-on)

| PROPERTIES | | | CONTROL | HT + REWET | HT ONLY |
|---|---|---|---|---|---|
| Basis Wt. (lb/3000 ft$^2$) | | | 223.6 | 223.2 | 220.2 |
| Caliper (0.001 in) | | | 22.4 | 21.9 | 21.3 |
| Tensile | Dry | MD | 123 | 127 | 132 |
| (lb/in) | | CD | 67 | 70 | 70 |
| % Stretch | | MD | 2.9 | 2.9 | 2.5 |
| | | CD | 4.3 | 4.6 | 3.4 |
| Tensile | Wet | MD | 27 | 38 | 43 |
| (lb/in) | | CD | 16 | 22 | 24 |
| % Stretch | | MD | 2.8 | 3.1 | 3.2 |
| | | CD | 5.6 | 6.0 | 5.9 |
| Mullen Burst | | Dry | 129 | 136 | 132 |
| (psi) | | Wet | 29 | 42 | 45 |
| Corrected Taber | | MD | 333 | 381 | 379 |
| Stiffness gm-cm | | CD | 188 | 215 | 219 |

TABLE 5.7

BLEACHED BOARD + IMPREGNATED WITH 1% $CaCl_2$ AND CONDENSED MILK (7% Proteins) (5% Add-on)

| PROPERTIES | | | CONTROL | HT + REWET | HT ONLY |
|---|---|---|---|---|---|
| Basis Wt. (lb/3000 ft$^2$) | | | 219.9 | 261.6 | 211.2 |
| Caliper (0.001 in) | | | 22.0 | 21.5 | 20.5 |
| Tensile | Dry | MD | 106 | 96 | 105 |
| (lb/in) | | CD | 58 | 59 | 58 |
| % Stretch | | MD | 2.5 | 2.4 | 2.1 |
| | | CD | 4.3 | 4.2 | 3.0 |
| Tensile | Wet | MD | 24 | 45 | 41 |
| (lb/in) | | CD | 15 | 22 | 24 |
| % Stretch | | MD | 2.7 | 3.0 | 2.8 |
| | | CD | 5.3 | 5.2 | 4.2 |
| Mullen Burst | | Dry | 114 | 88 | 92 |
| (psi) | | Wet | 29 | 38 | 35 |

TABLE 5.7-continued

| BLEACHED BOARD + IMPREGNATED WITH 1% $CaCl_2$ AND CONDENSED MILK (7% Proteins) (5% Add-on) | | | | |
|---|---|---|---|---|
| PROPERTIES | | CONTROL | HT + REWET | HT ONLY |
| Corrected Taber | MD | 330 | 349 | 340 |
| Stiffness gm-cm | CD | 164 | 172 | 174 |

EXAMPLE 6

Samples of unbleached kraft linerboard were subjected to the treatment of Example 5; the resulting products were tested as in Example 5. The results appear in the following tables.

TABLE 6.1

| UNBLEACHED BOARD (LINERBOARD) + NO ADDITIVES | | | | | |
|---|---|---|---|---|---|
| PROPERTIES | | | CONTROL | HT + REWET | HT ONLY |
| Basis Wt. (lb/1000 $ft^2$) | | | 49.5 | 49.8 | 49.6 |
| Caliper (0.001 in) | | | 13.4 | 13.3 | 13.4 |
| Tensile | Dry | MD | 99 | 115 | 105 |
| (lb/in) | | CD | 42 | 49 | 47 |
| % Stretch | | MD | 3.5 | 3.6 | 3.5 |
| | | CD | 4.2 | 4.4 | 4.4 |
| Tensile | Wet | MD | 9 | 27 | 24 |
| (lb/in) | | CD | 4 | 13 | 11 |
| % Stretch | | MD | 1.4 | 2.2 | 2.1 |
| | | CD | 3.8 | 4.4 | 4.3 |
| Mullen Burst | | Dry | 105 | 158 | 152 |
| (psi) | | Wet | 10 | 49 | 41 |
| STFI (lb/in) | | MD | 40 | 46 | 44 |
| | | CD | 28 | 31 | 32 |

TABLE 6.2

| UNBLEACHED BOARD + STARCH (8% Aqueous) (5.0% Add-on) | | | | | |
|---|---|---|---|---|---|
| PROPERTIES | | | CONTROL | HT + REWET | HT ONLY |
| Basis Wt. (lb/1000 $ft^2$) | | | 50.4 | 49.7 | 49.0 |
| Caliper (0.001 in) | | | 13.7 | 13.7 | 13.2 |
| Tensile | Dry | MD | 126 | 128 | 147 |
| (lb/in) | | CD | 67 | 54 | 64 |
| % Stretch | | MD | 5.5 | 4.7 | 5.5 |
| | | CD | 6.6 | 5.7 | 5.6 |
| Tensile | Wet | MD | 16 | 25 | 25 |
| (lb/in) | | CD | 7 | 12 | 12 |
| % Stretch | | MD | 2.1 | 2.4 | 2.4 |
| | | CD | 4.8 | 5.6 | 5.8 |
| Mullen Burst | | Dry | 222 | 196 | 190 |
| (psi) | | Wet | 18 | 34 | 38 |
| STFI (lb/in) | | MD | 47 | 48 | 53 |
| | | CD | 32 | 30 | 35 |

TABLE 6.3

| UNBLEACHED BOARD + SKIM MILK (3.5% Protein) (4.9% Add-on) | | | | | |
|---|---|---|---|---|---|
| PROPERTIES | | | CONTROL | HT + REWET | HT ONLY |
| Basis Wt. (lb/1000 $ft^2$) | | | 49.7 | 48.7 | 48.0 |
| Caliper (0.001 in) | | | 13.5 | 13.6 | 12.6 |
| Tensile | Dry | MD | 109 | 119 | 118 |
| (lb/in) | | CD | 43 | 45 | 54 |
| % Stretch | | MD | 3.9 | 4.4 | 4.0 |
| | | CD | 4.1 | 5.5 | 5.1 |
| Tensile | Wet | MD | 15 | 32 | 30 |
| (lb/in) | | CD | 6 | 15 | 15 |
| % Stretch | | MD | 1.7 | 2.6 | 2.8 |
| | | CD | 4.0 | 6.2 | 6.3 |
| Mullen Burst | | Dry | 133 | 183 | 164 |
| (psi) | | Wet | 16 | 53 | 58 |
| STFI (lb/in) | | MD | 47 | 58 | 54 |

TABLE 6.3-continued

| UNBLEACHED BOARD + SKIM MILK (3.5% Protein) (4.9% Add-on) | | | | |
|---|---|---|---|---|
| PROPERTIES | | CONTROL | HT + REWET | HT ONLY |
| | CD | 27 | 32 | 31 |

TABLE 6.4

| UNBLEACHED BOARD + CONDENSED MILK (7.0% Proteins) (4.9% Add-on) | | | | | |
|---|---|---|---|---|---|
| PROPERTIES | | | CONTROL | HT + REWET | HT ONLY |
| Basis Wt. (lb/1000 $ft^2$) | | | 52.3 | 50.8 | 48.6 |
| Caliper (0.001 in) | | | 13.6 | 13.6 | 12.5 |
| Tensile | Dry | MD | 103 | 98 | 115 |
| (lb/in) | | CD | 48 | 52 | 50 |
| % Stretch | | MD | 3.5 | 2.6 | 3.6 |
| | | CD | 5.1 | 5.3 | 4.5 |
| Tensile | Wet | MD | 12 | 38 | 36 |
| (lb/in) | | CD | 5 | 15 | 14 |
| % Stretch | | MD | 1.5 | 2.8 | 2.7 |
| | | CD | 4.3 | 6.0 | 6.6 |
| Mullen Burst | | Dry | 144 | 149 | 143 |
| (psi) | | Wet | 12 | 68 | 63 |
| STFI (lb/in) | | MD | 44 | 42 | 53 |
| | | CD | 26 | 34 | 32 |

TABLE 6.5

| UNBLEACHED BOARD + RECONSTITUTED DRY MILK (14% Proteins) (4.8% Add-on) | | | | | |
|---|---|---|---|---|---|
| PROPERTIES | | | CONTROL | HT + REWET | HT ONLY |
| Basis Wt. (lb/1000 $ft^2$) | | | 53.6 | 53.3 | 51.0 |
| Caliper (0.001 in) | | | 14.1 | 13.6 | 12.5 |
| Tensile | Dry | MD | 125 | 139 | 139 |
| (lb/in) | | CD | 53 | 61 | 66 |
| % Stretch | | MD | 3.4 | 4.5 | 4.6 |
| | | CD | 5.3 | 5.6 | 4.8 |
| Tensile | Wet | MD | 11 | 40 | 41 |
| (lb/in) | | CD | 5 | 18 | 17 |
| % Stretch | | MD | 1.6 | 3.8 | 3.5 |
| | | CD | 4.3 | 6.8 | 7.1 |
| Mullen Burst | | Dry | 166 | 199 | 178 |
| (psi) | | Wet | 14 | 95 | 81 |
| STFI (lb/in) | | MD | 48 | 66 | 62 |
| | | CD | 31 | 40 | 34 |

TABLE 6.6

| UNBLEACHED BOARD + STARCH: RECONSTITUTED DRY MILK (7.0% Proteins) (4.8% Add-on) | | | | | |
|---|---|---|---|---|---|
| PROPERTIES | | | CONTROL | HT + REWET | HT ONLY |
| Basis Wt. (lb/1000 $ft^2$) | | | 51.4 | 51.9 | 50.9 |
| Caliper (0.001 in) | | | 13.7 | 13.5 | 12.7 |
| Tensile | Dry | MD | 126 | 147 | 142 |
| (lb/in) | | CD | 45 | 56 | 51 |
| % Stretch | | MD | 4.1 | 4.5 | 4.1 |
| | | CD | 4.6 | 5.2 | 4.2 |
| Tensile | Wet | MD | 13 | 34 | 39 |
| (lb/in) | | CD | 5 | 15 | 14 |
| % Stretch | | MD | 1.6 | 3.2 | 3.3 |
| | | CD | 3.8 | 6.3 | 6.0 |
| Mullen Burst | | Dry | 168 | 193 | 171 |
| (psi) | | Wet | 16 | 69 | 70 |
| STFI (lb/in) | | MD | 49 | 66 | 64 |
| | | CD | 31 | 40 | 41 |

TABLE 6.7

UNBLEACHED BOARD + IMPREGNATED WITH 1% $CaCl_2$ AND CONDENSED MILK (7% Proteins) (5.1% Add-on)

| PROPERTIES | | | CONTROL | HT + REWET | HT ONLY |
|---|---|---|---|---|---|
| Basis Wt. (lb/1000 $ft^2$) | | | | 50.7 | 50.8 |
| Caliper (0.001 in) | | | | 13.8 | 13.0 |
| Tensile | Dry | MD | | 110 | 125 |
| (lb/in) | | CD | | 54 | 54 |
| % Stretch | | MD | | 3.5 | 3.5 |
| | | CD | | 6.0 | 4.4 |
| Tensile | Wet | MD | | 34 | 40 |
| (lb/in) | | CD | | 16 | 16 |
| % Stretch | | MD | | 3.9 | 2.9 |
| | | CD | | 6.1 | 6.8 |
| Mullen Burst | | Dry | | 164 | 149 |
| (psi) | | Wet | | 65 | 54 |
| STFI (lb/in) | | MD | | 45 | 54 |
| | | CD | | 30 | 33 |

The tables above show clearly that notable increases in wet strength, without substantial degradation of other qualities, are produced by heat treating paper having latex additives as described above. Use of the rewetting procedure is seen to improve folding endurance.

Inasmuch as the invention is subject to many variations and changes in detail, the foregoing description and examples should be regarded as illustrative of the invention defined by the following claims.

We claim:

1. A method of improving the stiffness, wet strength and opacity of a kraft paper product while maintaining acceptable flexibility thereof, comprising steps of applying an additive selected from the group consisting of (a) milk and (b) a mixture of equal proportions of potato starch in 8% aqueous solution and acrylic latex in 50% solution to said product, then heat treating said product at an internal temperature of at least 400° F. for a period of time sufficient to increase the wet strength thereof, and then rewetting the product immediately after said heat treating step before the product cools substantially.

2. The method of claim 1, wherein the product has an initial moisture content in the range of 1.0 to 20% by weight before said heat treating step.

3. The method of claim 1, wherein the moisture content of said product after rewetting is between 1.0 and 20% by weight.

4. The method of claim 1, wherein said heat treating step comprises heating said product to within the range of 400° F. to 482° F., for a length of time in the range of 0.5 to 120 seconds.

* * * * *